US007937783B2

(12) United States Patent
Qian et al.

(10) Patent No.: US 7,937,783 B2
(45) Date of Patent: May 10, 2011

(54) IMPELLER ENCLOSURE

(75) Inventors: Yin Qian, Milwaukee, WI (US); Norman R. Fugate, Milwaukee, WI (US)

(73) Assignee: European Touch Holdings, Inc., Milwaukee, WI (US)

( * ) Notice: Subject to any disclaimer, the term of this patent is extended or adjusted under 35 U.S.C. 154(b) by 1305 days.

(21) Appl. No.: 11/451,674

(22) Filed: Jun. 13, 2006

(65) Prior Publication Data

US 2007/0283489 A1 Dec. 13, 2007

(51) Int. Cl.
*A47K 3/022* (2006.01)

(52) U.S. Cl. ..... 4/622

(58) Field of Classification Search ..... 4/541.3, 4/622; 68/184; 366/264
See application file for complete search history.

(56) References Cited

U.S. PATENT DOCUMENTS

| | | | | |
|---|---|---|---|---|
| 555,860 | A | 3/1896 | Hanger | |
| 2,061,142 | A | 11/1936 | Denocenzo | |
| 2,250,315 | A * | 7/1941 | Rocke | 68/184 |
| 2,307,621 | A | 1/1943 | Dorton | |
| 2,312,524 | A | 3/1943 | Cox | |
| 2,336,127 | A * | 12/1943 | Rocke | 4/622 |
| 2,417,499 | A | 3/1947 | Ille | |
| 2,452,405 | A | 10/1948 | Vincent, Jr. | |
| D160,368 | S | 10/1950 | Centerbar | |
| 2,733,711 | A | 2/1956 | Gibson | |
| 2,738,787 | A | 3/1956 | Jacuzzi et al. | |
| 3,159,849 | A | 12/1964 | Jacuzzi | |
| 3,273,560 | A | 9/1966 | Jacuzzi | |
| 3,287,741 | A | 11/1966 | Nash | |
| 3,297,025 | A | 1/1967 | Jacuzzi | |
| 3,760,800 | A | 9/1973 | Staffin et al. | |
| 3,832,740 | A | 9/1974 | McClarrin | |
| 3,924,278 | A | 12/1975 | Ekman | |
| 3,940,807 | A | 3/1976 | Baker et al. | |
| 3,964,471 | A | 6/1976 | Saethre | |
| 3,965,495 | A | 6/1976 | McNair | |
| 4,004,302 | A | 1/1977 | Hori | |
| 4,100,917 | A | 7/1978 | Talge et al. | |
| 4,115,878 | A | 9/1978 | Johnson et al. | |
| 4,168,705 | A | 9/1979 | Raab | |
| 4,181,124 | A | 1/1980 | Pauletich | |
| 4,184,488 | A | 1/1980 | Bielich | |
| 4,330,412 | A | 5/1982 | Frederick | |

(Continued)

FOREIGN PATENT DOCUMENTS

DE 37 16 683 A1 12/1988

(Continued)

OTHER PUBLICATIONS

Golden Ratio Woodworks—The Grand Versailles, available at http://www.goldenratio.com/GRW/Spa/GrandVersailles.html, © 2005 Golden Ratio, All Rights Reserved (1 p.).

(Continued)

*Primary Examiner* — Lori Baker
(74) *Attorney, Agent, or Firm* — Foley & Lardner LLP

(57) ABSTRACT

A pedicure spa including a fluid retaining basin. An impeller operatively coupled to the basin. An enclosure removably coupled to the basin, the enclosure including an upper region and a lower region, and defining a plurality of orifices in the upper region and the lower region, with the enclosure configured to enclose the impeller and direct fluid flow towards a foot region of the basin defined between a wall of the basin and the lower region of the enclosure.

17 Claims, 4 Drawing Sheets

U.S. PATENT DOCUMENTS

| | | | |
|---|---|---|---|
| 4,349,434 | A | 9/1982 | Jaworski |
| 4,420,846 | A | 12/1983 | Bonner |
| 4,485,503 | A | 12/1984 | Rolando et al. |
| 4,520,525 | A | 6/1985 | Yogi et al. |
| 4,525,881 | A | 7/1985 | Higginbotham |
| D288,037 | S | 2/1987 | Orenstein |
| 4,665,572 | A | 5/1987 | Davidson et al. |
| 4,742,584 | A | 5/1988 | Abe |
| 4,853,987 | A | 8/1989 | Jaworski |
| 4,903,352 | A | 2/1990 | Murakami |
| 4,984,583 | A | 1/1991 | Peterson et al. |
| 5,044,357 | A | 9/1991 | Johns |
| 5,083,329 | A | 1/1992 | Murakami |
| D342,165 | S | 12/1993 | Marshall et al. |
| 5,414,878 | A | 5/1995 | Booth |
| D363,168 | S | 10/1995 | Lewis |
| D372,843 | S | 8/1996 | Trent et al. |
| 5,587,023 | A | 12/1996 | Booth |
| 5,588,161 | A | 12/1996 | Barradas |
| 5,729,841 | A | 3/1998 | Chan |
| 5,816,659 | A | 10/1998 | Wolf |
| D403,515 | S | 1/1999 | Lewis |
| 6,003,166 | A | 12/1999 | Hald et al. |
| D421,853 | S | 3/2000 | Black |
| D429,379 | S | 8/2000 | Kim |
| D434,916 | S | 12/2000 | Galati, Jr. et al. |
| D435,937 | S | 1/2001 | Back et al. |
| 6,357,059 | B1 | 3/2002 | Lau |
| D455,017 | S | 4/2002 | Tran |
| D455,566 | S | 4/2002 | Park |
| D456,154 | S | 4/2002 | Huynh et al. |
| 6,363,548 | B1 | 4/2002 | Kuo |
| 6,393,633 | B2 | 5/2002 | Ferber |
| 6,405,390 | B2 | 6/2002 | Kuen |
| 6,438,768 | B1 | 8/2002 | Yen |
| 6,503,212 | B2 | 1/2003 | Park |
| 6,565,522 | B1 | 5/2003 | Chen |
| 6,598,244 | B1 | 7/2003 | Yeh |
| D479,919 | S | 9/2003 | Genelli et al. |
| 6,659,112 | B1 | 12/2003 | Haupt |
| D487,533 | S | 3/2004 | Abbott et al. |
| D489,140 | S | 4/2004 | Froech |
| 6,732,387 | B1 | 5/2004 | Waldron |
| 6,790,188 | B2 | 9/2004 | Chen |
| 6,805,678 | B2 | 10/2004 | Cafaro |
| 6,880,182 | B2 | 4/2005 | Gruenwald |
| 6,916,297 | B2 | 7/2005 | Hafemann |
| 6,923,206 | B2 | 8/2005 | Glover et al. |
| 6,973,683 | B2 | 12/2005 | Lev et al. |
| 6,979,300 | B1 | 12/2005 | Julian et al. |
| D518,182 | S | 3/2006 | Cafaro et al. |
| 7,028,362 | B2 | 4/2006 | Davallou |
| 7,065,808 | B2 | 6/2006 | Leung et al. |
| 2004/0117905 | A1 | 6/2004 | Gruenwald |
| 2004/0177438 | A1 | 9/2004 | Gruenwald et al. |
| 2004/0216225 | A1 | 11/2004 | Booth et al. |
| 2005/0132487 | A1 | 6/2005 | Layfield et al. |
| 2007/0226896 | A1 | 10/2007 | Fugate et al. |

FOREIGN PATENT DOCUMENTS

| | | |
|---|---|---|
| JP | 6-46964 | 2/1994 |
| JP | 6-78858 | 3/1994 |
| JP | 6-339509 | 12/1994 |
| WO | WO 95/26706 A1 | 10/1995 |

OTHER PUBLICATIONS

SpaEquip: La Fleur Pedicure Chair from Gulfstream, available at http://www.spaequip.com/store/GSLF.jsp, © 2000-2004 SpaEquip, All Rights Reserved (1 p.).

European Patent Office Communication for Application 07784370.4, dated Apr. 15, 2010, 5 pages.

PCT International Search Report related to International Application No. PCT/US2007/070736, date of mailing of the International Search Report, Nov. 8, 2007, 3 pages.

PCT Written Opinion of the International Searching Authority relating to International Application No. PCT/US2007/070736, date of mailing Nov. 8, 2007, 7 pages.

* cited by examiner

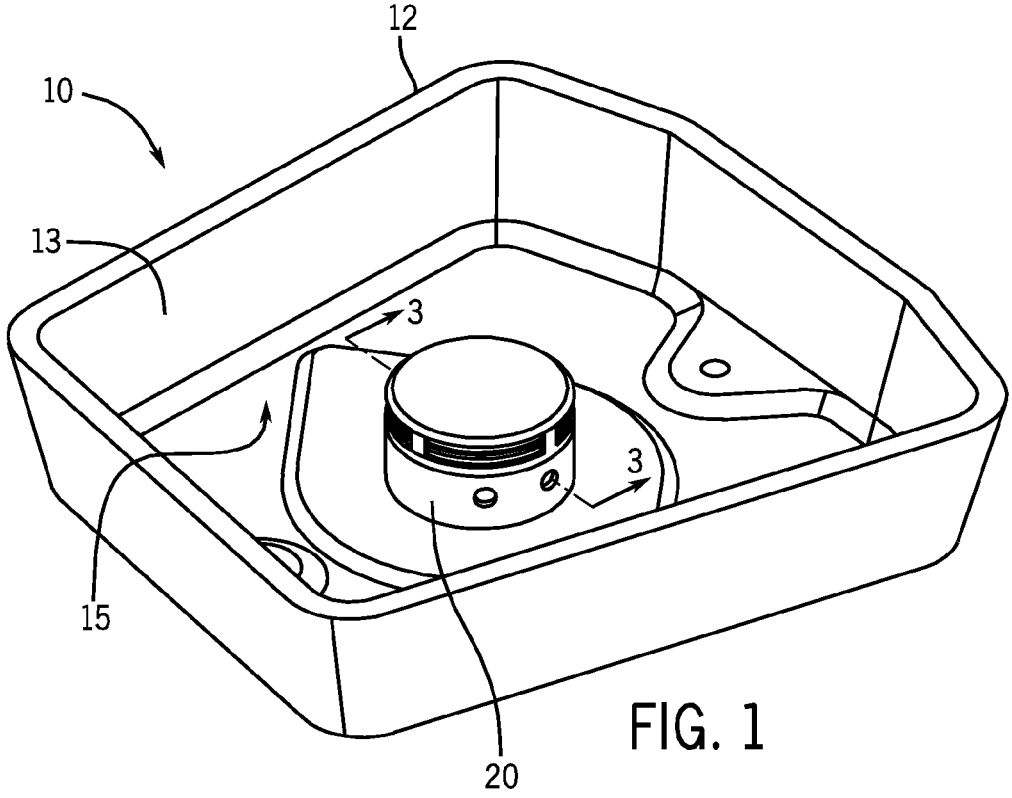
FIG. 1
FIG. 3
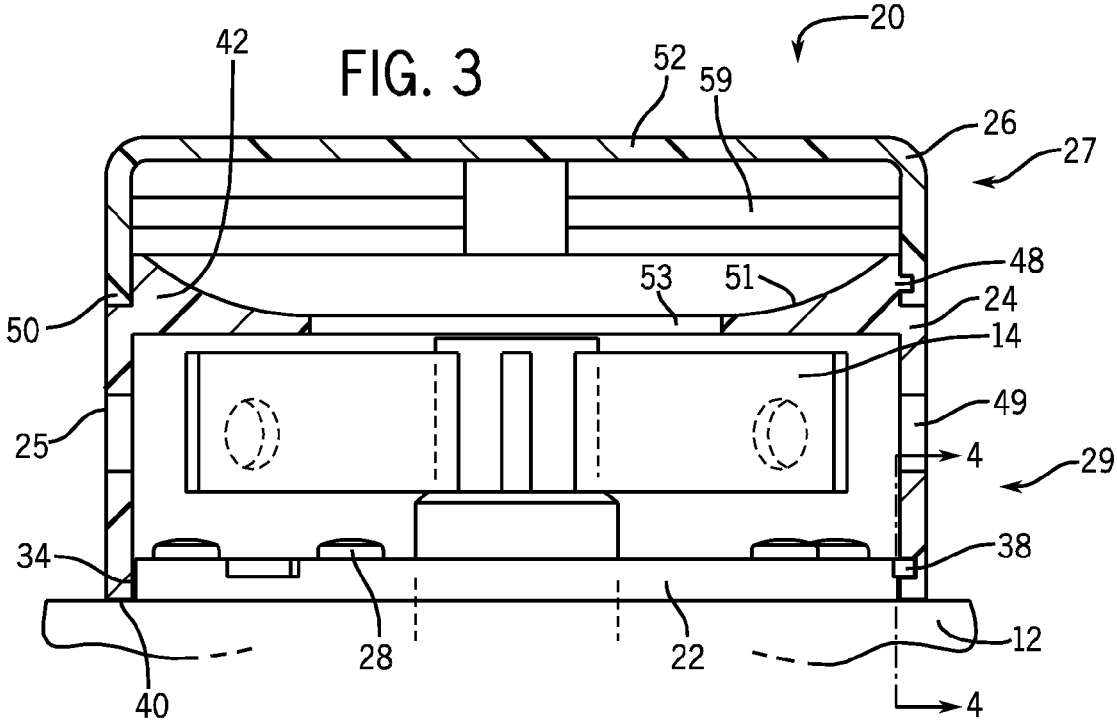

IMPELLER ENCLOSURE

FIELD OF THE INVENTION

The present invention relates generally to the field of spa devices. More specifically, the invention relates to a closure for an impeller for use in a fluid basin to provide a massaging effect in a pedicure spa.

BACKGROUND OF THE INVENTION

It is generally known to provide for a spa device, such as pedicure spas, health spas, whirlpools, jet stream exercisers, foot spas, etc. Such known spa devices are typically used in commercial and recreational settings for hydrotherapy, massage, stimulation, pedicure, and bathing purposes. However, such spa devices have several disadvantages including being difficult to thoroughly clean, requiring complicated maintenance schedules.

Water quality can become a problem in systems that use circulating water that comes into contact with the human body where the spa is not thoroughly cleaned. Several actions have been taken in an attempt to overcome this difficulty, including the addition of chemicals (e.g., bleach) into the water to help control bacteria growth. Despite such efforts, however, water quality is sometimes still difficult to maintain. For example, bacteria can develop simple defense mechanisms to counter chemical attacks such as forming a protective outer coating that acts as a barrier against harsh chemical treatments. The destruction of the outer coating is generally difficult with chemicals alone. Often times, chemicals are only effective in destroying the outer coating when used for extended periods of time, sometimes hours. Therefore, the preferred method of eliminating bacteria from systems is through mechanical means such as abrasion (e.g., removal with a rag and a chemical cleanser that has anti-bacterial capabilities). Furthermore, many spa devices have intricate and elaborate systems of pipes that move water from a pump, through a filtering system, and ultimately to one or more nozzles (e.g., openings) that deliver water back to a basin for re-circulation. In the case of a pedicure basin, the process of cleaning after each pedicure involves draining the water from the system, spraying the basin with some type of anti-bacterial cleanser, circulating the water for a period of time, rinsing and then refilling with fresh water. Because there are pipes and fittings, it is often difficult to mechanically scrub every component that comes into contact with water. In addition, after a system is drained, some water may remain within the piping system, usually in cracks and crevices or low spots in the pumping system. For example, the pump itself is usually a sealed unit that may be difficult to completely drain. It is within these areas that the bacteria tend to grow the outer coating as a defensive mechanism against attack from anti-bacterial chemicals, especially when the pedicure system is not used for extended periods (e.g., overnight, weekends, etc.). Consequently, water quality may be diminished in conventional piped systems that are not effectively cleaned.

Another problem with known spa devices is that they often provide a harsh massaging effect to the feet by pointing a small number of nozzles (e.g., openings) toward the feet. These nozzles are generally connected via pipes and hoses to a single centrifugal pump that produces a very high pressure (20-40 psi) and a relatively low volume of water. Customers often complain that the jets of water produced in this manner are too rough, in some cases even producing pain or discomfort. Although the jets can be partially closed to reduce the force of the water stream, this also reduces the water volume.

Consequently, the massage effect is minimized since the jets are often a considerable distance away from the feet (e.g., in the walls of the basin).

Accordingly, it would be advantageous to provide a spa apparatus that substantially avoids the problems of bacterial growth by eliminating the need for pipes and/or pumps. Further, it would be advantageous to provide a spa apparatus with a removable enclosure for the impeller that provides a series of apertures through which fluid is moved to create a massage effect. Further, it would be advantageous to provide an enclosure with a relatively small number of components that is easily removable to facilitate easy cleaning of the spa. Additionally, it would be desirable to provide an easily removable pump system that may be exchanged and/or cleaned in a sanitation bath or dishwasher.

SUMMARY OF THE INVENTION

One embodiment of the invention relates to a pedicure spa containing fluid including a fluid retaining basin. An impeller operatively coupled to the basin. An enclosure removably coupled to the basin, the enclosure including an upper region and a lower region, and defining a plurality of orifices in the upper region and the lower region, with the enclosure configured to enclose the impeller and direct fluid flow towards a foot region of the basin defined between a wall of the basin and the lower region of the enclosure.

Another embodiment of the invention relates to an enclosure for an impeller included in a pedicure spa having a fluid retaining basin. The enclosure includes a cylindrical impeller housing having a closed end proximate an upper region and an open end proximate a lower region. A plurality of orifices defined in the upper region and the lower region, with the impeller housing configured to enclose the impeller and direct fluid flow towards a foot region of the basin defined between a wall of the basin and the lower region of the impeller housing.

Another embodiment of the invention relates to a spa apparatus that includes a basin for retaining fluid. An impeller operatively coupled to the basin. A motor coupled to the impeller. An enclosure removably coupled to the basin, the enclosure having an upper region and a lower region, and defining a plurality of orifices in the upper region and the lower region, with the enclosure configured to enclose the impeller and direct fluid flow towards a foot region of the basin defined between a wall of the basin and the lower region of the enclosure, the enclosure including a gasket coupled to the basin, with the gasket defining a tab on the gasket circumference edge, a cylindrical impeller housing having a first end and a second end, with the impeller housing defining a first key slot proximate the first end and configured to engage the tab, and with the impeller housing defining a protrusion proximate the second end. A cover having a closed end and an open end, with the cover defining a second key slot proximate the open end and configured to engage the protrusion, wherein the impeller is in fluid communication with the basin and enveloped in the enclosure when the tab and first key slot are engaged and the protrusion and second key slot are engaged.

BRIEF DESCRIPTION OF THE DRAWINGS

FIG. 1 is an isometric view of a spa including an enclosure for an impeller according to an exemplary embodiment.

FIG. 3 is cross-section of the enclosure in FIG. 1 taken along line 3-3.

DETAILED DESCRIPTION OF EXEMPLARY EMBODIMENTS

Figure 2:
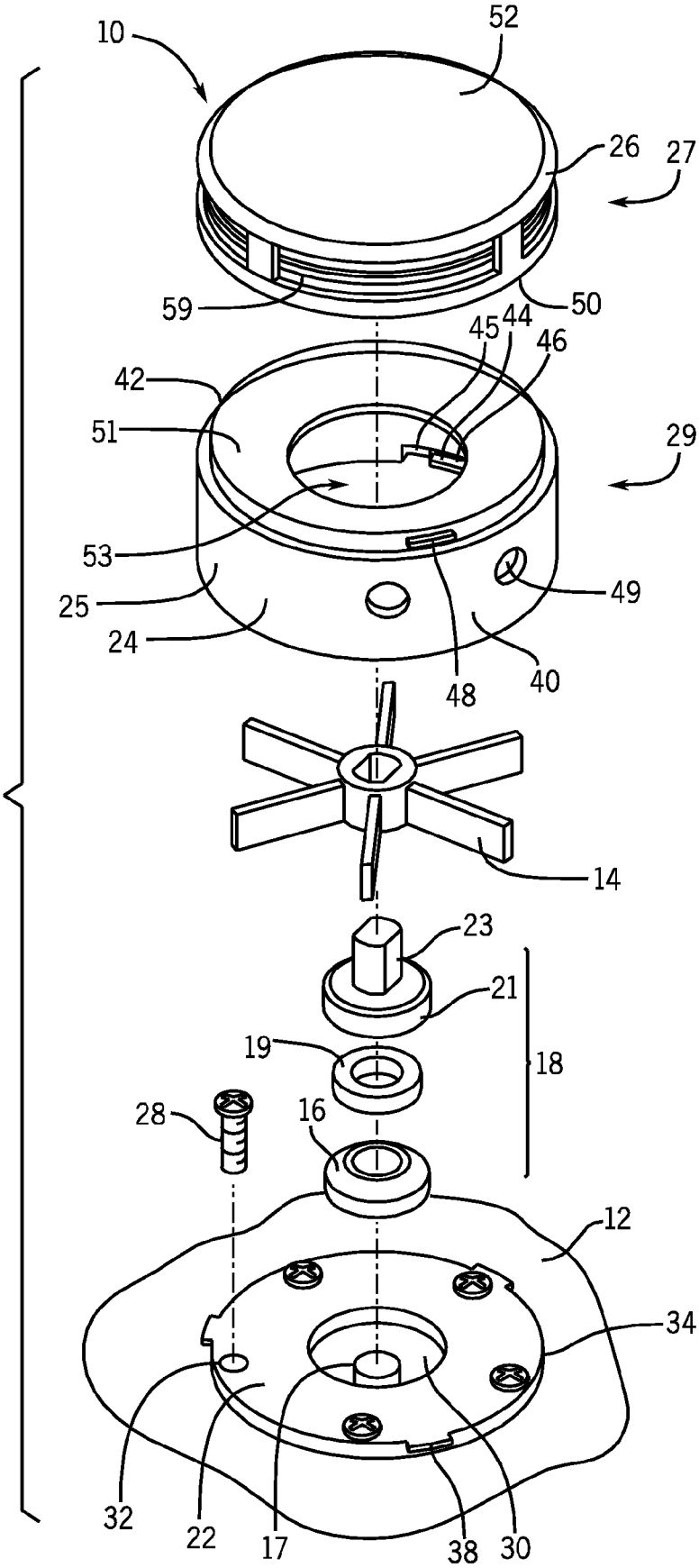
FIG. 2 is an exploded view of the enclosure and impeller system in FIG. 1 according to an exemplary embodiment.
Figure 4:
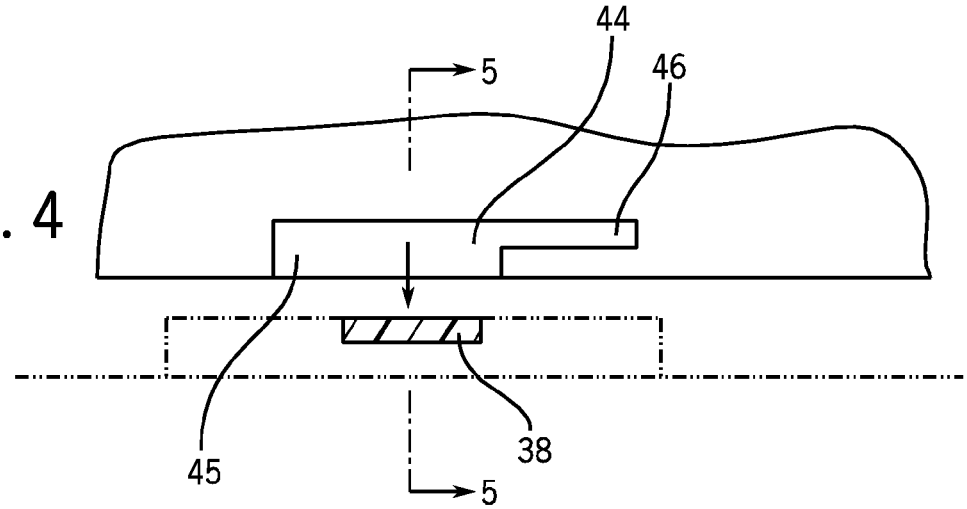
FIGS. 4-8 are partial cross-sections of the impeller enclosure in FIG. 3 showing the coupling of two components. The coupling involves a tab or protrusion on a first component and a key channel on a second component.
Figure 6:
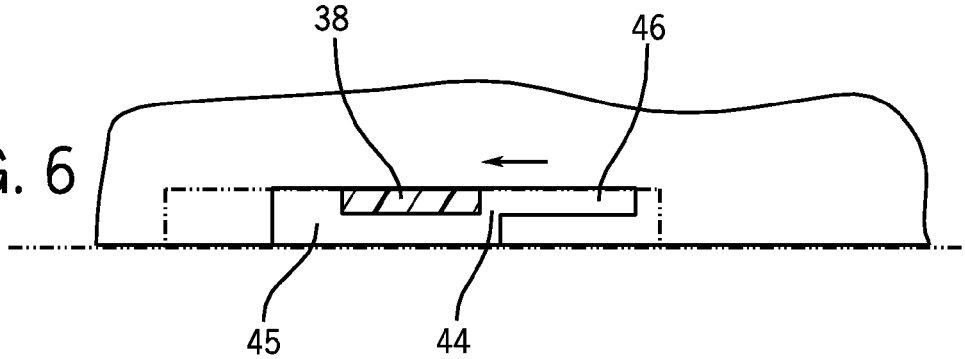
Figure 7:
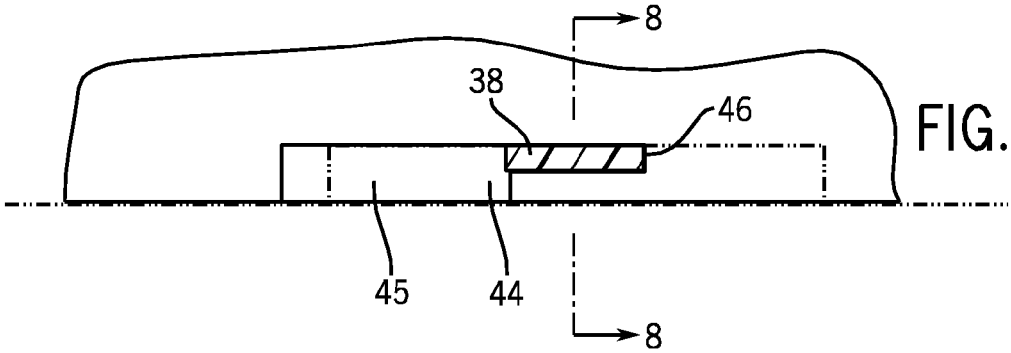
Figure 5:
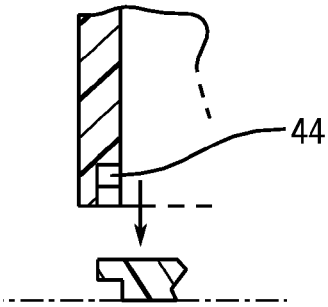
Figure 8:
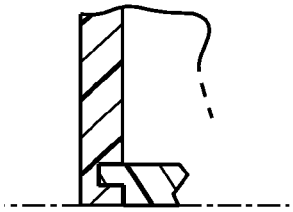

Referring to FIG. 1, an enclosure for an impeller for a pedicure spa 10 is shown according to an exemplary embodiment. According to an exemplary embodiment, a spa 10 includes a fluid-retaining basin 12 that is configured for use in foot massages, pedicures and other activities related to the feet, including bathing, soaking, stimulating, etc. It should be understood that other spa uses, for example a full body spa or a bath tub can employ the impeller enclosure system.

Basin 12 includes upright walls 13 and is configured to retain fluid (e.g., water) for use with various cleaning and/or massage activities. A foot region 15 is defined between the walls 13 of the basin 12 and the enclosure 20. Spa 10 also includes an impeller 14 operatively coupled to basin 12, and a motor (not shown) located external to basin 12 for rotating impeller 14.

An impeller coupling assembly 18 secures the impeller 14 to the motor pump shaft 17 while providing a water tight seal to prevent water from leaking from the basin. Impeller coupling assembly 18 a spring biased water seal 16 having a spring member such as a coil spring located therein, a carbon ring 19, and an upper impeller shaft 21.

Spring biased water seal 16 includes a lower metal plate holding the coil spring. An upper metal plate covers the top portion of the coil spring. A rubber jacket secures the upper and lower metal plates and coil spring together. The rubber jacket fits within the opening of the basin about threaded pump shaft 17.

Upper impeller shaft 21 includes a recess (not shown) facing the spring biased seal 16. A rubber housing is located within the recess to hold a ceramic ring seal that freely rotates on carbon ring seal 19. Upper impeller shaft 21 includes a female threaded bore that threadingly receives threaded pump shaft 17. Upper impeller shaft 21 further includes a keyed shaft 23 that is received within a keyed opening of impeller 14.

The impeller coupling assembly 18 is assembled by placing spring biased seal 16 within an opening of the basin proximate opening 30 of the lock plate 22. Carbon ring 19 is located in a recess proximate the top of spring biased seal 16. Upper impeller shaft 21 is threaded onto threaded pump shaft 17. As upper impeller shaft 21 is threaded on to pump shaft 17 spring biased seal 16 is compressed and the rubber jacket is forced outwardly forming the water tight seal. The ceramic ring within the upper impeller shaft 21 forms a rotating seal with carbon ring 19.

Referring now to FIGS. 2-8, in one exemplary embodiment, enclosure 20 is configured to substantially enclose impeller 14 and separate impeller 14 from the interior of basin 12. Enclosure 20 includes a lock plate 22, a cylindrical impeller housing 24, and an impeller cover 26. As explained further below, fluid is pulled into enclosure 20 by the action of impeller 14 and expelled from enclosure 20 wherein the massage effect is created.

Lock plate 22 is a generally flat member that is coupled between impeller housing 24 and basin 12. Lock plate 22 is an annular body with a central opening 30, a plurality of apertures 32 and an outer circumference edge 34. Lock plate 22 may also provide a sealing function and may be formed from any material that is suitable for substantially sealing the space between impeller housing 24 and basin 12 (e.g., silicone, polychloroprene rubber, etc). Central opening 30 receives a shaft 17 from the motor. Apertures 32 may be provided circumferentially in lock plate 22 to receive a fastening member, shown as screws 28, used to couple lock plate 22 to basin 12. Outer circumference edge 34 includes one or more generally evenly spaced coupling features, shown as tabs 38 (e.g., protrusions, projections, extensions, flaps, etc.). Tabs 38 are configured to engage features in impeller housing 24 to couple lock plate 22 to impeller housing 24.

Impeller housing 24 is a generally thin-walled member with an inner diameter approximately equal to the outer diameter of lock plate 22. Impeller housing 24 has a lower end 40 and a upper end 42 opposite lower end 40 and a sidewall 25 extending therebetween. Lower end 40 has a plurality of key slots 44 spaced approximately equal to the spacing of tabs 38 on lock plate 22. Upper end 42 has a plurality of generally evenly spaced coupling features, shown as tabs 48 (e.g., protrusions, projections, extensions, flaps, etc.) that extend outward from impeller housing 24. Tabs 48 are configured to engage features in cover 26 to couple impeller housing 24 to cover 26. Impeller housing 24 also includes one or more orifices 49 may be evenly spaced about the periphery of impeller housing 24 proximate lower end 40. Orifices 49 may also be located to face the sides of the basin and not the front and/or back in order to direct the flow. Further, orifices 49 may be located to face the forward part of the basin to create a flow that hits the front portion of the basin and then flows along bother side walls of the basin toward a rear region of the basin. Orifices 49 are openings (e.g., apertures, holes, outlets etc.) that allow fluid to be expelled from impeller housing 24. Impeller housing 24 may be composed of various materials including plastic, metal, or some combination of plastic and metal.

Referring now especially to FIGS. 4-8, a coupling mechanism, involving key slots 44 is shown. Key slots 44 have a vertical portion 45 extending inward from lower end 40 and a horizontal portion 46 extending sideways from the end of vertical portion 45 opposite lower end 40. Impeller housing 24 is coupled to lock plate 22 by sliding impeller housing 24 over lock plate 22, fitting tabs 38 into vertical portions 45 of key slots 44. Impeller housing 24 is then rotated slightly, sliding tabs 38 into horizontal portions 46 of key slots 44, substantially trapping tabs 38 in key slots 44.

Cover 26 is a generally cup-shaped member (e.g., lid, cap, top, etc) with a diameter that may be approximately equal to the diameter of impeller housing such that when cover 26 is coupled to impeller housing 24, they form a substantially smooth outer surface. Cover 26 has an open end 50 and a closed end 52 opposite open end 50. Open end 50 has a plurality of key slots spaced approximately equal to the spacing of tabs 48 on impeller housing 24. Cover 26 is coupled to impeller housing 24 in a manner similar to the manner impeller housing 24 is coupled to lock plate 22. When cover 26 is engaged with impeller housing 24, impeller housing 24 and cover 26 form a single unitary member enveloping impeller 14. Cover 26 also includes one or more arcuate slots 59 evenly spaced about the periphery of cover 26 proximate closed end 52. Arcuate slots 59 are openings (e.g., apertures, holes, inlets etc.) that allow fluid flow into the impeller housing 24. Cover 26 may be composed of various materials including plastic, metal, or some combination of plastic and metal.

Enclosure 20 defines an upper region 27 and a lower region 29. Enclosure 20 directs fluid flow towards the foot region 15 which in one exemplary embodiment is defined between a wall 13 of basin 12 and lower region 29 of enclosure 20. Upper region 27 and lower region 29 of enclosure 20 can be separated by an intermediate baffle 51 positioned inside enclosure 20. Intermediate baffle 51 defines a circular opening 53, typically centrally located. Circular opening 53 provides fluid communication between upper region 27 and lower region 29 of enclosure 20. Intermediate baffle 51 may be formed integrally with impeller housing 24. It is also contemplated that baffle 51 may define a plurality of openings to provide fluid communication within enclosure 20. However, circular opening 53 provides a funneling effect of the fluid from upper region 27 to lower region 29. This provides enhanced flow from impeller 14 to orifices 49 in impeller housing 24.

Referring to FIGS. 2 and 3, intermediate baffle 51 extends inwardly from enclosure housing 24 and extends over a portion of the impeller 14. Impeller 14 has a rotational axis and an outer edge distal from the rotational axis. Baffle 51 extends inwardly over the outer edge of the impeller 14 toward the rotational axis of impeller 14. Baffle opening 53 is offset from the outer edge of impeller 14 toward the rotational axis of impeller 14.

According to other exemplary embodiments, the fluid pressure may be raised or lowered by changing the shape or number of either orifices 49 or arcuate slots 59.

Figure 9:
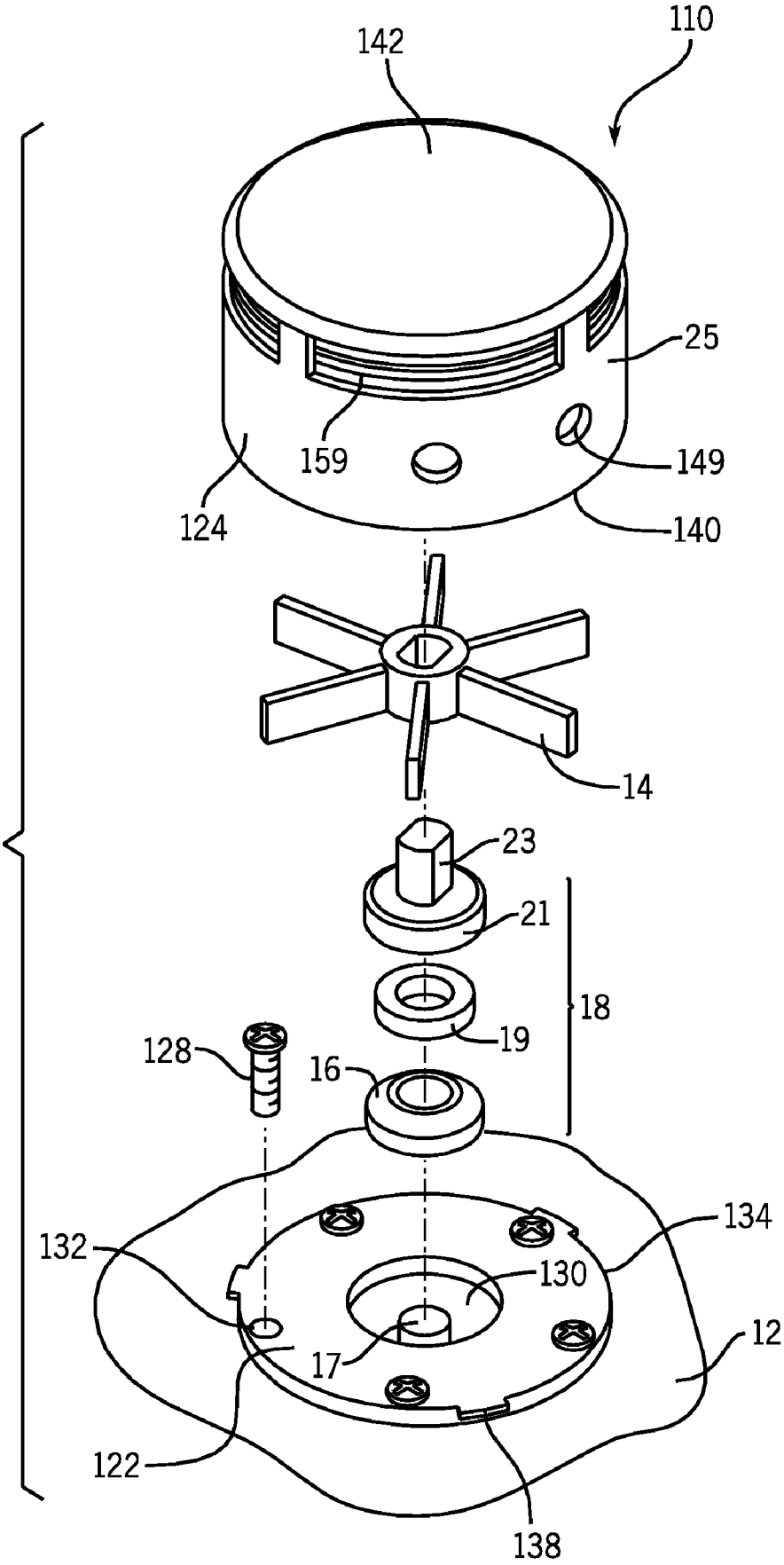
FIG. 9 is an exploded view of an enclosure for an impeller according to another exemplary embodiment.

Referring now to FIG. 9, an enclosure is shown according to another exemplary embodiment. Enclosure 110 is configured to substantially enclose impeller 14 and separate impeller 14 from the interior of basin 12. Enclosure 110 comprises a lock plate 122 and a cylindrical impeller housing 124. Lock plate 122 is a generally flat sealing member that is coupled between impeller housing 124 and basin 12. Lock plate 122 is an annular body with a central opening 130, a plurality of apertures 132 and an outer circumference edge 134. Central opening 130 receives a shaft 17 from the motor. Apertures 132 may be provided circumferentially in lock plate 122 to receive a fastening member, shown as screws 128 used to couple lock plate 122 to basin 12. Lock plate 122 may be plastic and/or any material that is suitable for substantially sealing the space between impeller housing 124 and basin 12 (e.g., silicone, polychloroprene rubber, etc). Outer circumference edge 134 includes one or more generally evenly spaced coupling features, shown as tabs 138 (e.g., protrusions, projections, extensions, flaps, etc.). Tabs 138 are configured to engage features in impeller housing 124 to couple lock plate 122 to impeller housing 124.

Impeller housing 124 is a generally thin-walled member with an inner diameter approximately equal the outer diameter of lock plate 122. Impeller housing 124 has an open end 140 and a closed end 142 opposite open end 140. Open end 140 has a plurality of key slots 44 spaced approximately equal to the spacing of tabs 138 on lock plate 122. Impeller housing 124 is coupled to lock plate 122 by sliding impeller housing 124 over lock plate 122, fitting tabs 138 into vertical portions 45 of key slots 44. Impeller housing 124 is then rotated slightly, sliding tabs 138 into horizontal portions 46 of key slots 44, substantially trapping tabs 138 in key slots 44 and compressing lock plate 122 between impeller housing 124 and basin 12. Impeller housing 124 also includes one or more orifices 149 evenly spaced about the periphery of impeller housing 124 proximate open end 140. Orifices 149 are openings (e.g., apertures, holes, outlets etc.) that allow fluid to be drawn into enclosure 120 by impeller 14. Impeller housing 124 also includes one or more arcuate slots 159 evenly spaced about the periphery of impeller housing 124 proximate closed end 142. Arcuate slots 159 are openings (e.g., apertures, holes, inlets etc.) that allow fluid to be pushed out of enclosure 120 by impeller 14. Impeller housing 124 may be composed of various materials including plastic, metal, or some combination of plastic and metal. Similar to impeller housing 20 shown in FIG. 2, impeller housing 124 may include a baffle similar to baffle 51 located therein.

According to other exemplary-embodiments, the fluid pressure may be raised or lowered by changing the shape or number of either orifices 149 or arcuate slots 159.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

The present disclosure has been described with reference to example embodiments, however workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the preferred and other exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, the pitch of the blades of impeller 14 may be changed to change the direction of fluid flow from the bottom to top of the impeller housing. The pitch of the blades could also be configured to increase the pressure of the fluid flow if this is desired. Additionally, the blades of the impeller could be arranged such that the water flowed into the impeller housing through openings 49 and exited through openings 59. It is also contemplated that openings 59 could be located on the lower portion of impeller housing 20 and openings 49 could be located on the upper portion of impeller housing 20. Impeller as used herein covers both an impeller and propeller. Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the preferred and other exemplary embodiments without departing from the spirit of the present subject matter.

What is claimed is:

1. A pedicure spa containing fluid, comprising:

a fluid retaining basin;

an impeller coupled to the basin;

an enclosure removably coupled to the basin, the enclosure including an upper region and a lower region, and defining a plurality of orifices in the upper region and the lower region, with the enclosure configured to enclose the impeller and direct fluid flow towards a foot region of the basin defined between a wall of the basin and the lower region of the enclosure, and an intermediate baffle positioned in the enclosure and separating the upper region and the lower region, with the baffle defining an annular opening, wherein the upper region is in fluid communication with the lower region, the impeller being located in the lower region and the baffle extending inwardly from the enclosure and extending over a portion of the impeller.

2. The pedicure spa of claim 1, wherein the enclosure is a cylindrical impeller housing having a closed end proximate the upper region and an open end proximate the lower region.

3. The pedicure spa of claim 2, including a lock plate coupled to the basin, with the lock plate defining a tab on the lock plate circumference edge, and the enclosure defines a key slot proximate the open end and configured to receive the tab within a portion of the key slot, wherein the enclosure is secured to the basin.

4. The pedicure spa of claim 2, wherein the closed end of the enclosure is removably secured to the impeller housing.

5. The pedicure spa of claim 1, wherein the impeller and enclosure are configured to direct fluid flow from the basin into the upper region of the enclosure and from the lower region of the enclosure back into the basin.

6. The pedicure spa of claim 1, wherein the orifices are one of circular holes and elongated slots.

7. The pedicure spa of claim 6, wherein the orifices are configured to produce a predetermined fluid pressure in the basin.

8. The pedicure spa of claim 1, wherein the enclosure is composed of material from a group consisting of metal, plastic, and a combination of metal and plastic.

9. The pedicure spa of claim 1, wherein the orifices are defined in a side wall of the enclosure.

10. A spa apparatus comprising:

a basin for retaining fluid;

an impeller coupled to the basin; and an enclosure removably coupled to the basin, the enclosure having an upper region and a lower region, and defining a plurality of orifices in the upper region and the lower region, with the enclosure configured to enclose the impeller and direct fluid flow towards a foot region of the basin defined between a wall of the basin and the lower region of the enclosure, the enclosure including a lock plate coupled to the basin, with the lock plate defining a tab on the lock plate circumference edge, a cylindrical impeller housing having a first end and a second end, with the impeller housing defining a first key slot proximate the first end and configured to engage the tab, and with the impeller housing defining a protrusion proximate the second end; and a cover having a closed end and an open end, with the cover defining a second key slot proximate the open end and configured to engage the protrusion, wherein the impeller is in fluid communication with the basin and enveloped in the enclosure when the tab and first key slot are engaged and the protrusion and second key slot are engaged.

11. The spa apparatus of claim 10, wherein the orifices are defined in a sidewall of the impeller housing.

12. The spa apparatus of claim 10, wherein the orifices are evenly spaced around the perimeter of the impeller housing and cover.

13. The spa apparatus of claim 10, wherein the orifices and arcuate slots are configured to produce a predetermined fluid pressure in the basin.

14. The spa apparatus of claim 10, wherein one of the impeller housing and cover is composed of material from a group consisting of metal, plastic, and a combination of metal and plastic.

15. The spa apparatus of claim 10, wherein the impeller housing and cover are a single unitary member.

16. The spa apparatus of claim 10, wherein the basin is configured as a pedicure basin.

17. The spa apparatus of claim 1, wherein the impeller has a rotational axis and an outer edge distal from the rotational axis, the baffle extending inwardly over the outer edge of the impeller toward the rotational axis of the impeller, the baffle opening being offset from the outer edge of the impeller toward the rotational axis of the impeller.

* * * * *